US011951411B2

(12) United States Patent
Forgrave et al.

(10) Patent No.: US 11,951,411 B2
(45) Date of Patent: Apr. 9, 2024

(54) MARBLE ACTUATED TURNTABLE

(71) Applicant: Global Family Brands, LLC, Indianapolis, IN (US)

(72) Inventors: Jeffrey Forgrave, Indianapolis, IN (US); Chris Suen, Kowloon (HK)

(73) Assignee: Pike Brands LLC, Seattle, WA (US)

( * ) Notice: Subject to any disclaimer, the term of this patent is extended or adjusted under 35 U.S.C. 154(b) by 533 days.

(21) Appl. No.: 17/038,636

(22) Filed: Sep. 30, 2020

(65) Prior Publication Data

US 2021/0093981 A1 Apr. 1, 2021

Related U.S. Application Data

(60) Provisional application No. 62/908,544, filed on Sep. 30, 2019.

(51) Int. Cl.

| | |
|---|---|
| ***A63H 18/02*** | (2006.01) |
| ***A63H 33/08*** | (2006.01) |
| ***A63H 33/26*** | (2006.01) |

(52) U.S. Cl.

CPC ..... *A63H 18/025* (2013.01); *A63H 18/02* (2013.01); *A63H 33/08* (2013.01); *A63H 33/26* (2013.01)

(58) Field of Classification Search

CPC ..... A63H 18/025; A63H 18/02

See application file for complete search history.

(56) References Cited

U.S. PATENT DOCUMENTS

| | | | | | |
|---|---|---|---|---|---|
| 3,854,716 | A * | 12/1974 | Spiegel | A63H 13/20 | 472/7 |
| 3,865,376 | A * | 2/1975 | Glass | A63F 7/0005 | 273/125 A |
| 3,946,516 | A * | 3/1976 | Wirth | A63F 7/3622 | 446/117 |
| 4,153,250 | A * | 5/1979 | Anthony | A63F 7/02 | 273/129 R |
| 4,713,038 | A * | 12/1987 | Wichman | A63F 7/3622 | 446/168 |
| 4,874,342 | A * | 10/1989 | Klitsner | A63F 7/3622 | 446/168 |
| 4,932,917 | A * | 6/1990 | Klitsner | A63F 7/3622 | 446/168 |
| 5,007,876 | A * | 4/1991 | Klitsner | A63F 7/3622 | 446/168 |

(Continued)

*Primary Examiner* — Eugene L Kim
*Assistant Examiner* — Alyssa M Hylinski
(74) *Attorney, Agent, or Firm* — Maginot, Moore & Beck, LLP

(57) ABSTRACT

An animation module is configured for use on a marble run module of a plurality of physically interconnectable marble run modules. The module includes a connector, an actuator, switch contacts, and a motor. The connector connects to a connector tube of a first marble run module of the plurality of physically interconnectable marble run modules. The actuator has a button and a shaft, and is configured to dispose at least a portion of the button below a bottom of the connector. The shaft extends upward from the button. The switch contacts are mounted at least indirectly on the connector and have a closed state and an open state. The motor is operably coupled to the switch contacts to rotate responsive to the switch contacts transitioning between the open state and the closed state.

19 Claims, 8 Drawing Sheets

(56) References Cited

U.S. PATENT DOCUMENTS

| | | | | | |
|---|---|---|---|---|---|
| 5,312,285 | A * | 5/1994 | Rieber | A63F 7/3622 | 273/109 |
| 5,683,298 | A * | 11/1997 | Jackson | A63H 18/02 | 463/58 |
| 5,785,573 | A * | 7/1998 | Rothbarth | A63F 7/3622 | 446/171 |
| 5,816,887 | A * | 10/1998 | Rudell | A63H 18/025 | 446/427 |
| 6,536,763 | B1 * | 3/2003 | Braun | A63F 7/3622 | 273/123 R |
| 6,945,839 | B2 * | 9/2005 | Quercetti | A63H 18/06 | 104/53 |
| 6,991,509 | B1 * | 1/2006 | Carley | A63H 33/006 | 434/335 |
| 9,925,471 | B2 * | 3/2018 | Flores | A63H 18/00 | |
| 9,956,493 | B1 * | 5/2018 | Hunts, Jr. | A63H 33/046 | |
| 10,272,309 | B2 * | 4/2019 | Moody | A63F 7/0058 | |
| 10,653,970 | B2 * | 5/2020 | Forgrave | A63F 7/3075 | |
| 10,850,205 | B2 * | 12/2020 | Forgrave | A63H 33/22 | |
| 11,478,694 | B2 * | 10/2022 | Forgrave | A63H 33/08 | |
| 11,779,853 | B2 * | 10/2023 | Forgrave | A63F 7/3622 | 446/122 |
| 2002/0034982 | A1 * | 3/2002 | Mejia | A63F 7/3622 | 463/69 |
| 2007/0209543 | A1 * | 9/2007 | Beaulieu | A63F 7/3622 | 104/53 |
| 2014/0011425 | A1 * | 1/2014 | Christopherson | A63H 18/02 | 446/227 |
| 2018/0236350 | A1 * | 8/2018 | Johnston | A63H 18/02 | |

* cited by examiner

MARBLE ACTUATED TURNTABLE

This application claims the benefit of U.S. Provisional Patent Application Ser. No. 62/908,544, filed Sep. 30, 2019, which is incorporated herein by reference.

FIELD OF THE INVENTION

The present invention is related to building toys, and more specifically, kits for designing and building marble run tracks.

BACKGROUND

Marble run toys known in the art have interconnecting track sections that may be arranged by a user in a wide variety of designs. Once constructed, the connected track sections define a downhill track through the various sections or modules. The interchangeable nature of the various module designs allows for the construction of many different marble run layouts.

FIG. 1 shows an exemplary marble run layout 10 formed of a plurality of interconnecting modules 11A, 11B, 11C, 11D, 11E, 11F and 18. The modules may take many forms, such as modules 11A, 11B and 11C, which include channels 12 that laterally direct a marble from a vertical receiving tube 14 to an exit tube 16. The channels 12 may define circuitous routes, such as those modules 11B and 11C. Other modules are merely vertical tubes 18 that can be used as part of the track, or merely as vertical support structures for other modules. Still other modules 11D can include a wide platform 20 with spikes 22 to direct the ball in an unpredictable path from the vertical receiving tube 24 and the exit tube 26. Other modules 11E can include a bowl structure. Other modules having additional or alternative features are known.

In popular marble run kits, the vertical receiving tube 14 of each module is generally designed to directly physically connect to an exit tube 16 of an upstream module, thus allowing the marble to transition from module to module. In FIG. 1, most of the receiving tubes 14 are disposed within part of the exit tube 16 of an upstream module, and therefore are not in view. However, the vertical receiving tube 14 of the module 11A is visible.

The modules may have other tubes or structures 28 under the vertical receiving tube 14 to allow that portion of the module to connected to other modules in the same way. Similarly, the modules may have a bypass tube 30 disposed vertically above the exit tube 16 that may provide support as well as an alternative input. The bypass tube 30 has the same general shape as the vertical receiving tube 14 and thus is configured to receive an exit tube 16 of an upstream module.

Like many construction toys, the marble run kits currently available allow for creative play by enabling the user to construct the marble run (or multiple runs) in a multitude of configurations. Unlike many construction toys, however, the marble run kits have the added advantage providing feedback of the player's design via movement of the marble. Accordingly, marble run kits have enjoyed pervasive success.

It would be advantageous to create a toy kit that builds on the advantages of the marble run kits with additional functionality and/or effects while preserving the appealing aspects of the original design.

SUMMARY

At least one embodiment described herein is a marble actuated turntable that creates animation in response to sensing the passing of a marble on a portion of a marble track. The sensing may suitably be carried out by a marble-actuated switch. In one embodiment, the marble-actuated switch, the motor and the turntable form a module that connects to any of a plurality of commercially available marble track modules used to build marble tracks. The turntable may include a three-dimensional object that rotates or revolves with the turntable.

A first embodiment is an animation module configured for use on a marble run module of a plurality of physically interconnectable marble run modules. The module includes a connector, an actuator, switch contacts, and a motor. The connector connects to a connector tube of a first marble run module of the plurality of physically interconnectable marble run modules. The actuator has a button and a shaft, and is configured to dispose at least a portion of the button below a bottom of the connector. The shaft extends upward from the button. The switch contacts are mounted at least indirectly on the connector and have a closed state and an open state. The motor is operably coupled to the switch contacts to rotate responsive to the switch contacts transitioning between the open state and the closed state.

A second embodiment is also an animation module configured for use on a marble run module of a plurality of physically interconnectable marble run modules. The animation module in this embodiment includes a housing, a motor and a platen. The housing connects to a first marble run module of the plurality of physically interconnectable marble run modules. The motor is operably coupled to rotate responsive to receiving a drive signal. The platen is supported on the housing and is operably coupled to the motor to rotate responsive to rotation of the motor.

In either case the rotating motor provides the source of animation for the module, which can be triggered by detection of a marble.

The above-described features and advantages, as well as others, will become more readily apparent to those of ordinary skill in the art by reference to the following detailed description and accompanying drawings.

DETAILED DESCRIPTION

Figure 1:
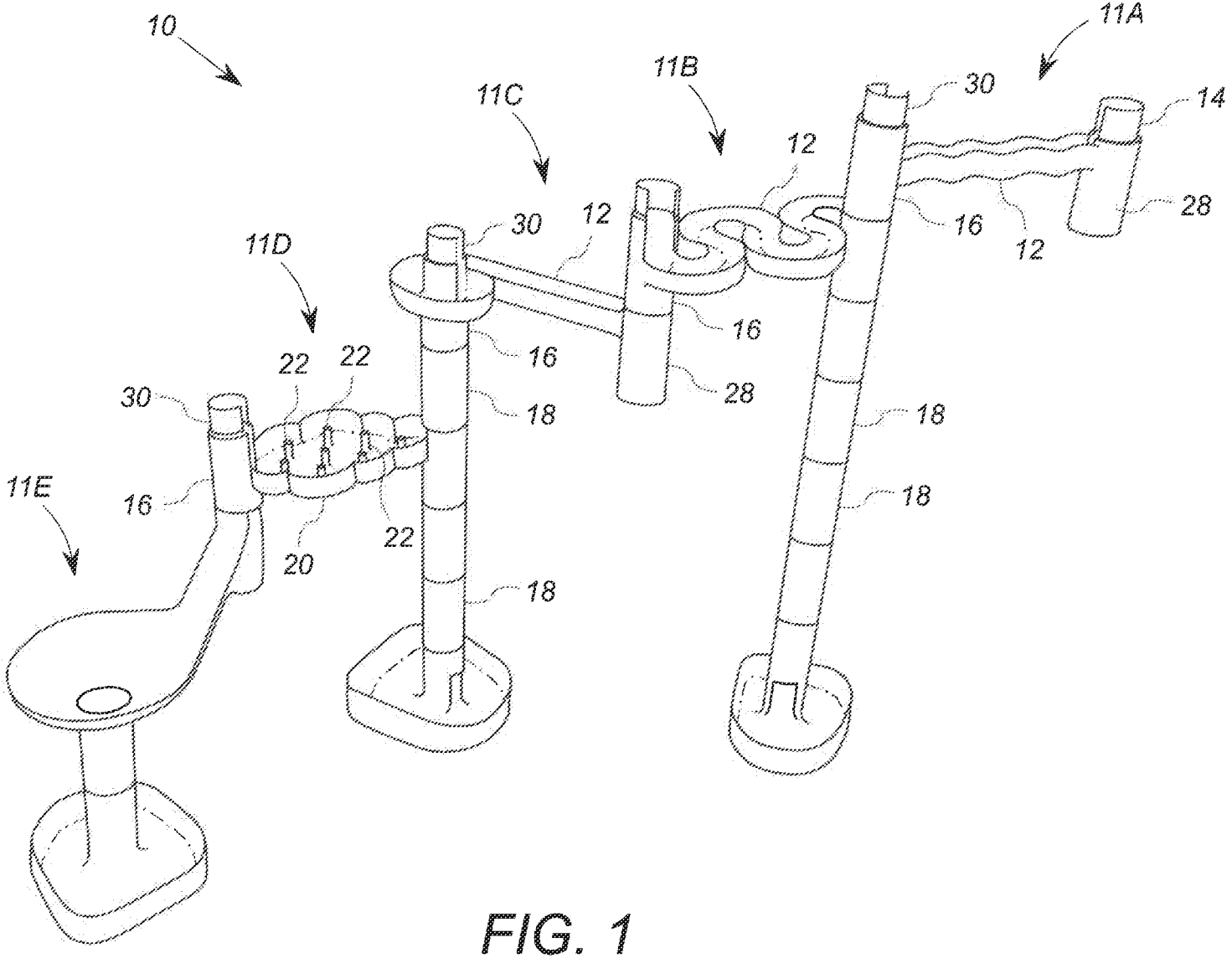
FIG. 1 shows an exemplary marble run constructed of a plurality of interconnectable marble run modules.
Figure 2:
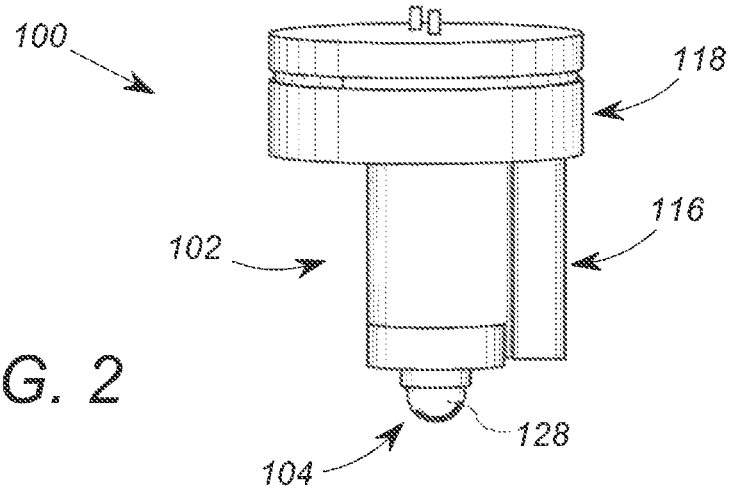
FIG. 2 shows a perspective view of an animation module according to a first embodiment.
Figure 3:
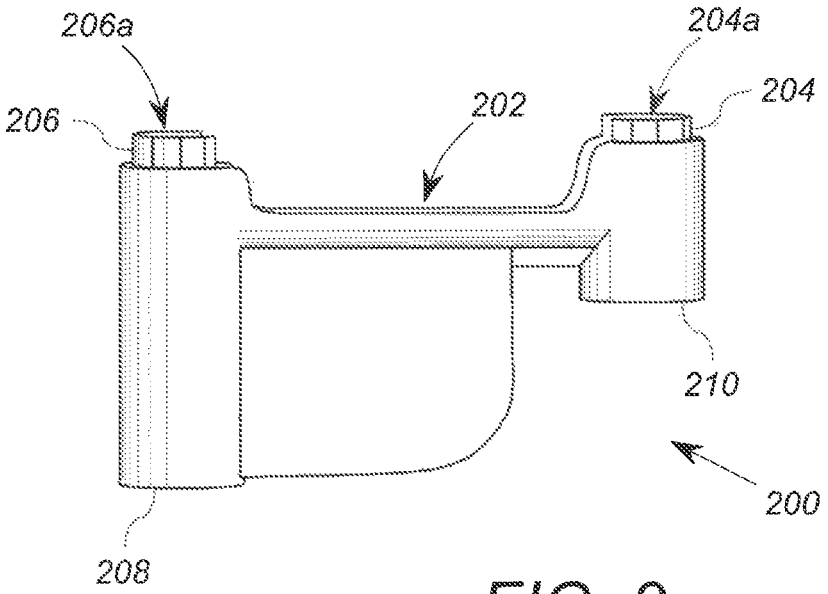
FIG. 3 shows a perspective view of a prior art marble run module to which the animation module of FIG. 2 may be removable attached.
Figure 4:
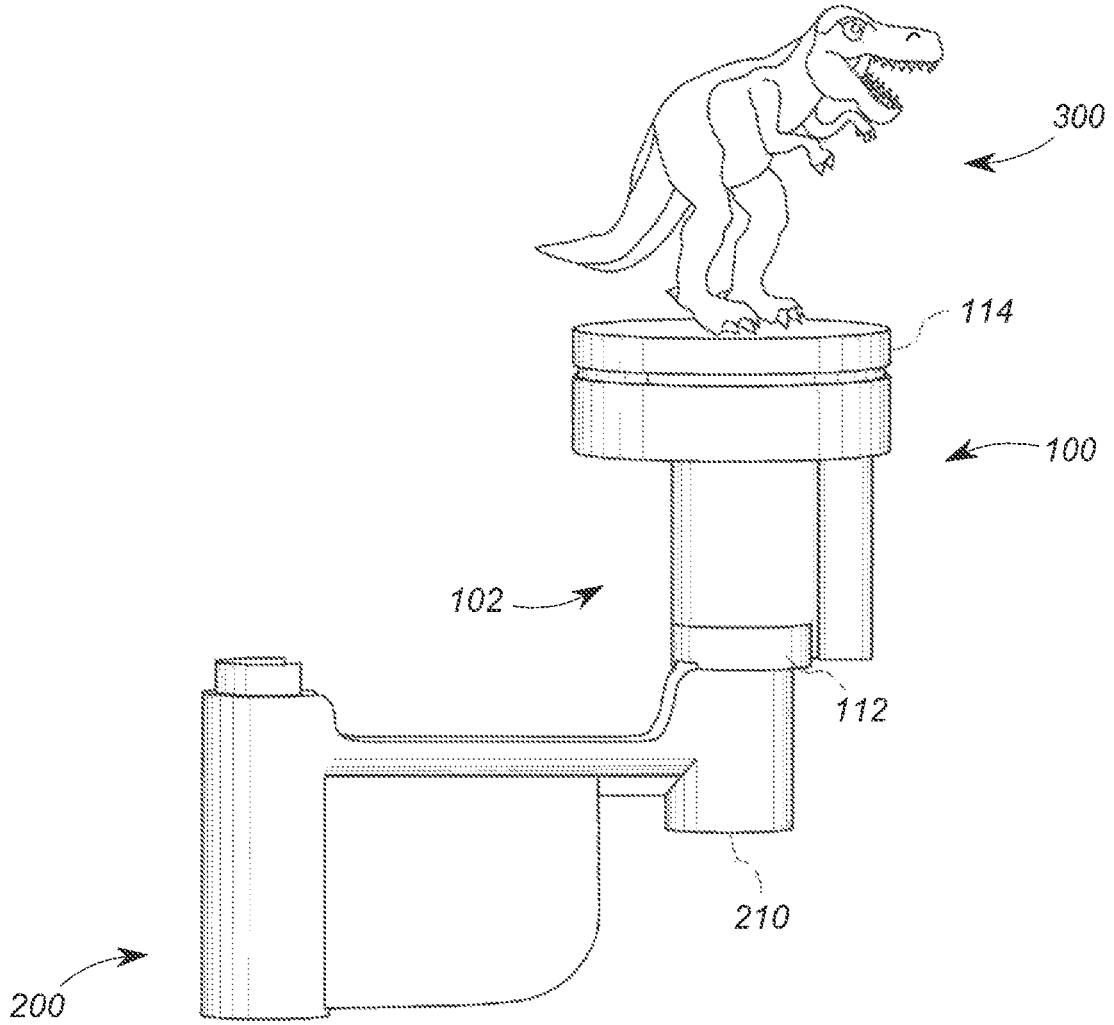
FIG. 4 shows a perspective view of the animation module of FIG. 2 attached to the prior art marble run module of FIG. 3.
Figure 5:
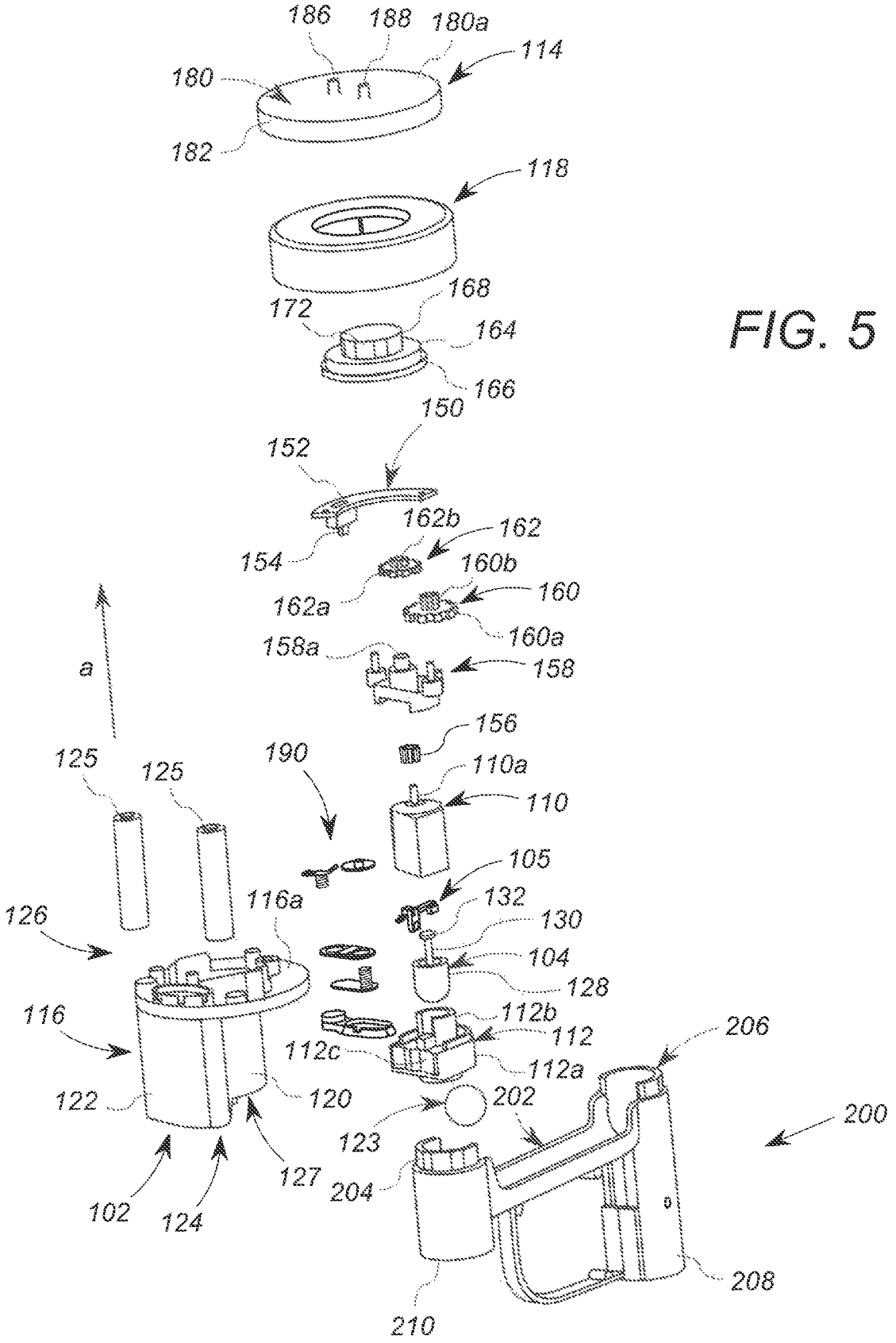
FIG. 5 shows an exploded perspective view of an exemplary embodiment of the animation module of FIG. 2.

FIG. 2 shows a perspective view of an exemplary embodiment of an animation module 100 configured for use in connection with other marble track modules such as those shown in FIG. 1. FIG. 3 shows a perspective view of an exemplary track module 200 upon which the animation module may be assembled. FIG. 4 shows a perspective view of the animation module 100 assembled onto an exemplary track module 200, and with a three-dimensional play figurine 300 attached thereto. It will be appreciated that the turntable module 100 may be assembled onto modules 11A, 11B, 11C and 11D of FIG. 1 in an analogous manner. FIG. 5 shows an exploded view of the turntable module 100 and the track module 200.

With reference to FIGS. 2 to 5, the module 100 includes housing 102, an actuator 104, a switch 105, a motor 110, and a rotating platform or platen 114. With reference to FIG. 3, the marble run module 200 has a marble run path 202 and a plurality of connector tubes 204, 206, 208, 210. Each of the connector tubes 204, 206 comprises a rim that extends around a central opening that is wide enough to receive a marble (e.g. marble 123 of FIG. 5). Each of the connector tubes 208, 210 includes a rim that extends around a central opening that is wide enough to receive either of the connector tubes 204, 206. To this end, the connector tubes 204 and 206 may have the same construction as the vertical receiving tube 14 of the module 11A of FIG. 1, and the connector tubes 208, 210 may have the same construction as the tubes 16 of the modules 11A, 11B, 11C and 11D. The marble run path 202 is configured to retain a marble and guide the travel of the marble through the module 200. The marble run path 202 may suitably include a straight U-shaped channel, as shown in FIGS. 3 and 4, or may take the form of any of the channels 12 of the modules 11A, 11B, 11C, and 11D of FIG. 1. The marble path 202 also includes any openings in the tubes 204, 206, 208 and 210 through which the marble 123 may travel.

In general, the module 100 is designed to attach to a module of a marble run kit, such as those shown in FIG. 1 and the module 200 of FIGS. 3 and 4, and to provide an aspect of movement responsive to detection of a marble present or passing through a predetermined location. For example, with reference to FIG. 4, the module 100 is attached to the module 200, and is configured to perform a movement responsive to a marble being detected in the path 202. In this case, the module 100 features rotational movement of the platen 114. As shown in FIG. 4, a three-dimensional figurine 300 can be affixed to the platen 114. As a result, the rotation of the platen 114 causes rotation of the three-dimensional figurine 300.

In further detail, the housing 102 of the module 100 is configured to connect the connection tube of an interconnectable marble run module. In this embodiment, the housing 102 includes a connector 112 that is configured to fit over and connect to either of the connector tubes 204, 206 of the module 200. In FIG. 4, the connector 112 is shown connected to the connecting tube 204. The housing 102 further includes a base 116 and a cover 118. The base 116 defines a main compartment 120 and a battery compartment 122, and has an upper shelf 116*a*. The main compartment 120 is roughly cylindrical and has a central passage 127 extending in the axial direction a from the bottom 124 to top 126. The battery compartment 122 extends axially along the main compartment 120 and is shaped to receive two AAA size batteries 123. The upper shelf 116*a* is in this embodiment is circular, and is located at the top end 126. The upper shelf 116*a* extends over the main compartment 120 and battery compartment 122, and extends further beyond both to complete the circular shape. The central passage 127 extends through the upper shelf 116*a* as well as the main compartment 120.

The connector 112 includes an outer rim 112*a*, in inner tube 112*b*, and a frame structure 112*c*. The outer rim 112*a* is sized to fit snugly over the connector tube 204 such that the housing 102 is firmly supported above the connector tube 204, as shown in FIG. 4. The inner tube 112*b* is a partial cylinder through which the actuator 104 extends. The frame structure 112*c* connects to and is formed with the outer rim 112*a* and inner tube 112*b*, and defines a series of surfaces and/or ribs to support other elements of the module 100, as will be discussed below. The outer rim 112*a* and the frame 112*c* couple to the bottom of the main compartment 120, such that the inner tube 112*b* extends upward into the central passage 127, and downward past the outer rim 112*a*.

With reference to FIGS. 2 and 5, the actuator 104 has a button 128, a shaft 130, and a contact plate 132. The actuator 104 operably coupled to the housing 102 to dispose at least a portion of the button 128 in the path 202 of the marble run module 200. The shaft 130 extends upward from the button 128, and terminates at the contact plate 132. In this embodiment, shaft 130 extends through a portion of the inner tube 112*b*, and button 128 extends downward past the level of the outer rim 112*a*. The contact plate 132 and/or shaft may suitably interact with features of the frame structure 112*c* to prevent the actuator from falling out of the module 100.

The switch 105 is mounted on the housing 102 in the central passage 127. The switch 105 has a closed state and an open state. In the closed state, an electrical connection exists through the switch 105. In the open state, the electrical connection through the switch 105 is interrupted. As will be discussed below, the motor 110 operably coupled to the contacts of the switch 105 to rotate responsive to the switch 105 transitioning to the closed state. However, it will be appreciated that the motor 110 in other embodiments is operably coupled to rotate when the switch transitions to the open state.

Figure 6:
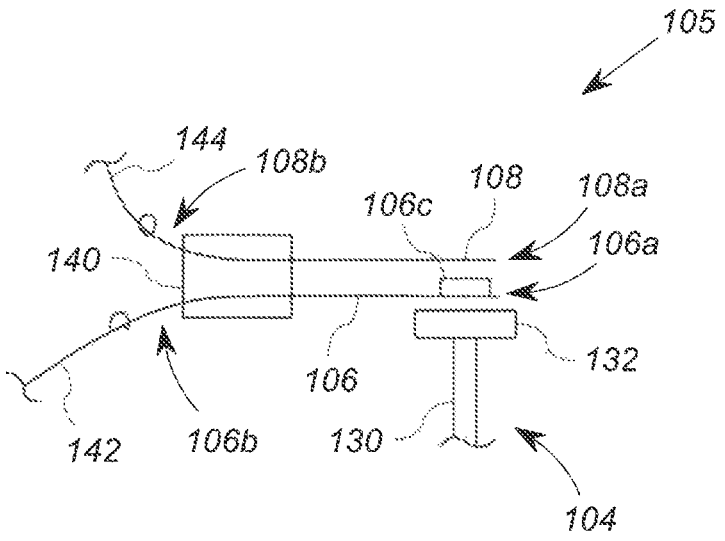
FIG. 6 shows a fragmentary side plan view of a switch and part of an actuator of the animation module of FIG. 5.

To this end, FIG. 6 shows a side plan view of an exemplary embodiment of the switch 105, with a portion of the actuator 104 in context. The switch includes first and second conductive contacts 106, 108 affixed to a non-conductive block 140. Each of the first and second contacts 106, 108 may suitably be an elastically deformable metal pin or bar. The first contact 106 is affixed to the block 140 such that a first end 106*a* of the contact 106 extends out one side of the block, and a second end 106*b* extends out the other side of the block 140. The first contact 106 includes in this embodiment includes a conductive block 106*c* disposed at the first end 106*a*. The second end 106*b* of the first contact 106 is physically and electrically coupled to a first wire 142.

The second contact 108 is affixed to the block 140 in a similar way, alongside but spaced apart from the first contact 106. Thus, similar to the first contact 106, a first end 108*a* of the contact 108 extends out one side of the block, and a second end 108*b* extends out the other side of the block 140. The first end 108*a* of the second contact 108 is disposed next to the first end 106*a* of the first contact 106. The second end 108*b* is physically and electrically coupled to a second wire 144. The conductive block 106*c* of the first contact 106 is disposed facing the first end 108*a* of the second contact 108.

In this embodiment, at least the first contact 106 is spring biased to be in a position shown in FIG. 6, where the first contact 106 and the second contact 108 run alongside each other, and where the second contact 108 is not in contact with any part of the first contact 106. However, vertical upward movement of the shaft 130 of the actuator 104 causes the contact plate 132 to push the first end 106*a* of the contact 106 such that the first end 106*a* overcomes the spring bias and deforms toward the first end 108*a* of the second contact 108. The vertical upward movement causes the conductive block 106*c* to make physical and electrical contact with the contact 108. Thus, vertical upward movement of the rod 130 causes the circuit through the switch 105 between the wires 142, 144 to be closed. In this embodiment, the contact plate 132 of the actuator 104 need not be electrically conductive, because it merely moves the spring biased contact 106 into contact with the contact 108. Other variants of suitable switches may be used with varying degrees of desirability.

Referring again to FIG. 5, as discussed above, the motor 110 is operably connected to rotate responsive to the switch 105 being in the closed position in this embodiment. To this end, the module 100 includes a control circuit 150 configured to cause a drive signal (operating power) to be provided to motor 110 for a predetermined duration responsive to an activation signal, such as one produced by the closing of the switch 105. The control circuit 150 is disposed in part or in whole in a small printed circuit board (PCB) 152. The PCB 152 also includes an on-off switch 154. The PCB 152 is mounted on the upper shelf 116*a*, such that the on-off switch 154 is accessible via an opening, not shown, in the upper shelf 116*a*.

Figure 7:
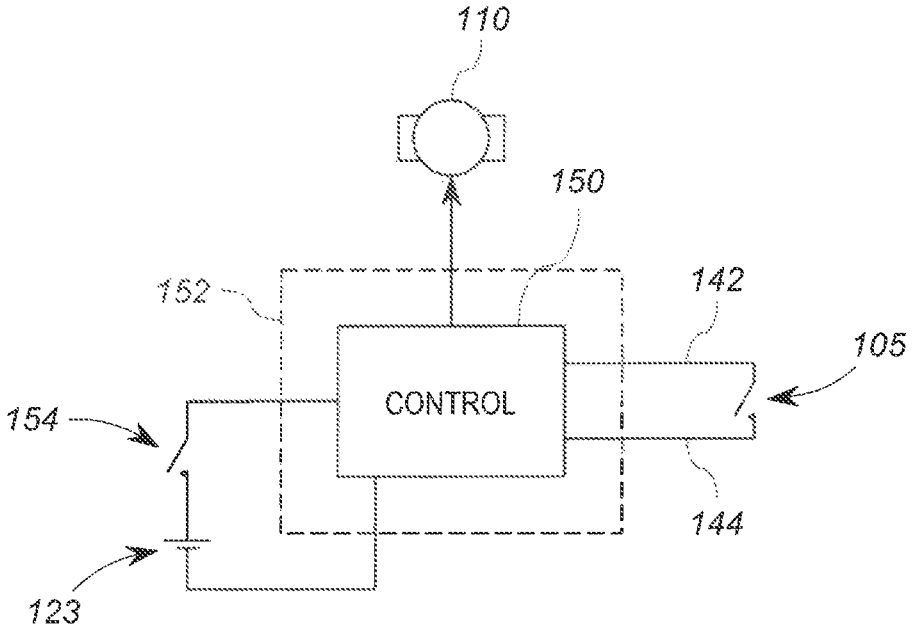
FIG. 7 shows a schematic diagram of the electrical components of the module of FIG. 5.

FIG. 7 shows a schematic diagram of the electrical components of the module 100. The control circuit 150 is configured to provide a drive signal to drive the motor 110 for a predetermined duration (e.g. three seconds) upon receiving an activation signal. In this embodiment, the activation signal is the signal that results from closing the connection between the wires 142, 144 through the switch 105. The control circuit 150 thus includes any suitable latch circuit, including those using digital processing to allow power to be provided to the motor 110 for a predetermined duration responsive to receiving the activation signal (i.e. detecting the instantaneous connection between the wires 142, 144).

To provide the drive signal, the control circuit 150 is operably coupled to the batteries 125 via the on-off switch 154. The control circuit 150 is further operably connected to the switch 105 via wires 142 and 144. The control circuit 150 includes logic and/or analog timing components to cause the motor 110 to be operably connected to receive power from the batteries 125 (i.e. the drive signal) for a predetermined amount of time upon the control circuit 150 detecting a closed circuit across the wires 142, 144.

Referring again to FIG. 5, the module 100 further includes a first gear 156, a gear mount 158, a first reduction gear 160, a second reduction gear 162, a pedestal 164, which cooperate to couple the motor 110 to the platen 114. The motor 110 is disposed in the central passage 127 of the main compartment 120 such that the output shaft 110*a* rotates about the axial direction a. The first gear 156 is disposed on the output shaft 110*a* of the motor 110. The gear mount 158 is also disposed in the main compartment 120, and provides axles for the first reduction gear 160 and the second reduction gear 162. The gear mount 158 also includes a stationary spindle 158*a* extending axially upward.

The first reduction gear 160 is a 3-to-1 reduction gear having a large gear 160*a* and a small gear 160*b* that are fixed to each other and have a common axis. Similarly, the second reduction gear 162 is a 4-to-1 reduction gear having a large gear 162*a* and a small gear 162*b* that are fixed to each other and have a common axis. The axles of the gear mount 158 is configured and positioned such that the large gear 160*a* of the first reduction gear 160 meshes with the first gear 156, and the small gear 160*b* of the first reduction gear 160 meshes with the large gear 162*a* of the second reduction gear 162. As will be discussed below, the small gear of the second reduction gear meshes with a further gear on the pedestal 164.

Figure 8:
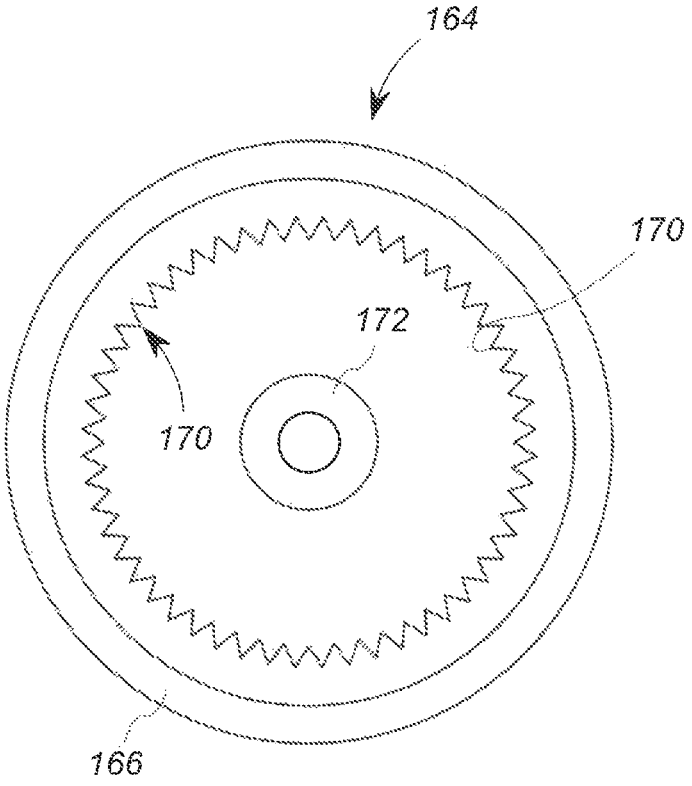
FIG. 8 shows a bottom plan view of a pedestal of the module of FIG. 5.

In particular, FIG. 8 shows a bottom plan view of the pedestal 164. With reference to FIGS. 5 and 8, the pedestal 164 comprises a disk 166 having an axially extending upper flange 168, an internal ring gear 170, and a central collar 172. The central collar 172 fits on the spindle 158*a* of the gear mount 158, such that the pedestal 164 can rotate with respect to the gear mount 158 about the spindle 158*a*. The internal ring gear 170 meshes with the small gear 162*b* of the second reduction gear 162. Accordingly, rotation of the output shaft 110*a* of the motor 110 causes rotation of the pedestal 164 via the gears 156, 160, 162 and 170. The upper flange 168 is in the form of an annular ring, and has one or more outer surface features 172 that interrupt the circular pattern of the outer surface. In this embodiment, the outer surface features 172 comprise a series of cords defining a polygonal outer surface of the upper flange 168. The surface features 172 are designed to mesh or otherwise cooperate with features on the underside of the platen 114, not shown in FIGS. 5 and 8, to cause the platen 114 to rotate when the pedestal 164.

Figure 9:
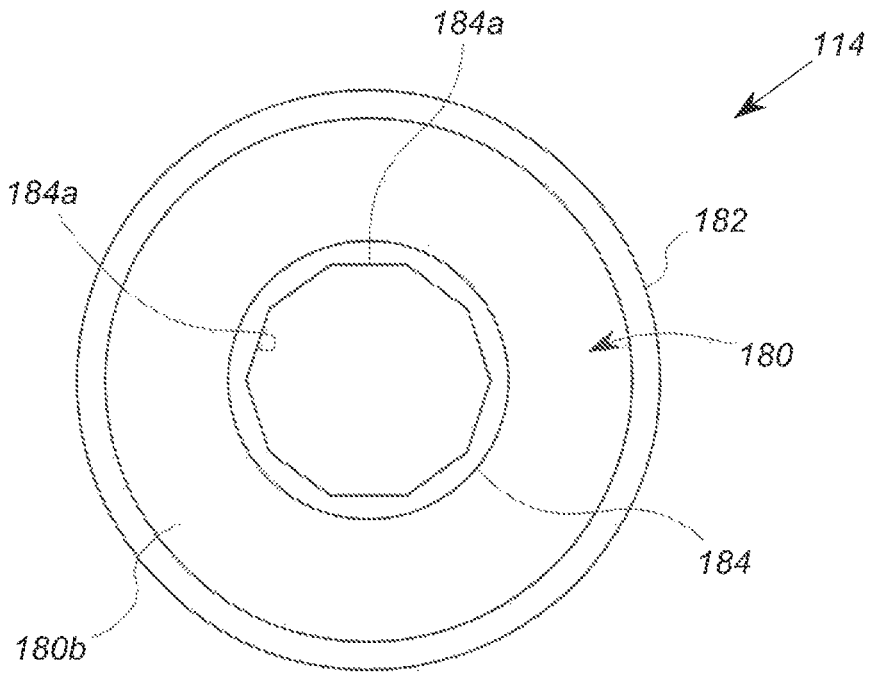
FIG. 9 shows a bottom plan view of the platen of the module of FIG. 5.

In particular, FIG. 9 shows a bottom plan view of the platen 114. With reference to FIGS. 5 and 9, the platen 114 in this embodiment has a plate 180, an annular skirt 182, an interior rim 184 and first and second pins 186, 188. The plate 180 is in the shape of a circular disk, but may take other shapes in other embodiments without changing the basic functionality. The plate 180 has a top surface 180*a* and a bottom surface 180*b*. The annular skirt 182 extends axially from the outer edge of the bottom surface 180*b*. The interior rim 184 likewise extends downward from the bottom surface 180*b*, and is concentric to the annular skirt 182. The interior rim 184 includes inner surface features 184*a* that are configured to mesh with the outer surface features 172 of the pedestal 164. Via the interior rim 184 and the pedestal 164, the platen 114 is removably secured to the pedestal 164.

With specific reference to FIGS. 2 and 5, the pins 186, 188 extend from the top surface 180*a* of the plate 180, and are configured to engage bores/receptacles of play figures, such as the figurine 300. Although not shown, suitable bores are disposed in the bottom of the figurine 300 of FIG. 2, and the pins 186, 188 engage to bores to hold the figurine 300 in position on the platen 114. The pins 186, 188 hold the play figures in place so that rotation of the platform during use corresponding rotates the figurine 300. It will be appreciated the more or fewer pins may be used, and their placement in other embodiments may vary to give varying degrees of play figure rotation and/or play figure revolution. The figurine 300 may readily be removed and replaced with other figurines having similar bores. The play figures may take any form, such as dinosaurs, space ships, human action figures, vehicles, robots, and the like.

In an alternative embodiment, pins similar to pins 186 and 188 are formed on the pedestal 164, and extend through holes in the plate 180. In such a case, the pins would serve to drive rotation of the platen 114 with the pedestal 164, and the surface features 172, 184*a* would not be necessary.

It will be appreciated that the module 100 also includes a conventional battery contact assembly 190 that supports batteries 125 and provides electrical contact thereto in a conventional manner.

With reference to FIGS. 1 to 9 generally, the module 100 in operation is typically connected to the connecting portion of a bypass tube of one of the modules 11A-11D or 200. In the example of FIGS. 3 and 4, the outer rim 112*a* of the connector 112 is secured to the connecting tube 204 of the module 200, and a figurine 300 is placed on the pins 186, 188. To place the device in active mode, the switch 154 is closed to provide power to control circuit 150. The module 200 may suitable be connected to other modules in an assembled marble run similar to the one shown in FIG. 1.

When the marble 123 is received by the connecting tube 206 of the module 200, it rolls down the path 202 to the connecting tube 204. Due to placement of the module 100, the resilient bulb 128 is disposed within the connecting tube 204 in the path 202, and is impacted by the marble 128 as it enters the connecting tube 204. The bulb 128 moves sufficiently upon impact to allow the marble 128 to drop through the opening of the tube 204 and out of the track module 200 (presumably into the receiving tube of another track module, e.g. 11A-11E of FIG. 1).

The deformation of the bulb 128 due to marble impact moves the rod 130 vertically upward, causing the contact plate 132 to change the state of the switch 110. With reference to FIG. 6, the upward movement of the shaft 130 and contact plate 132 deforms the spring loaded contact 106 toward the second contact 108 until the conductive block 106*c* contacts the second contact 108, thereby closing the switch 105. Referring to FIG. 7, the control circuit 150 detects the closure of the switch 105, and as a consequence, causes battery power to be provided to the motor 110 for a predetermined time, such as three seconds.

Referring again to FIG. 5, the rotation of the motor rotates the first gear 156, which in turn, drives the first reduction gear 160 and thus the second reduction gear 162. The small gear 162*b* of the second reduction gear 162 drive the internal ring gear 170 of the pedestal 164, thereby causing the pedestal 164 to rotate. Because of the engagement of surface features 172 and 184*a*, the rotation of the pedestal 164 causes the platen 114 to rotate, which in turn causes the pins 186, 188 to rotate. The ornamental figurine 300 placed on the pins 186, 188 thus also rotates for the predetermined duration.

After a time period, another marble may contact the bulb 128 and cause the process to repeat.

Figure 10:
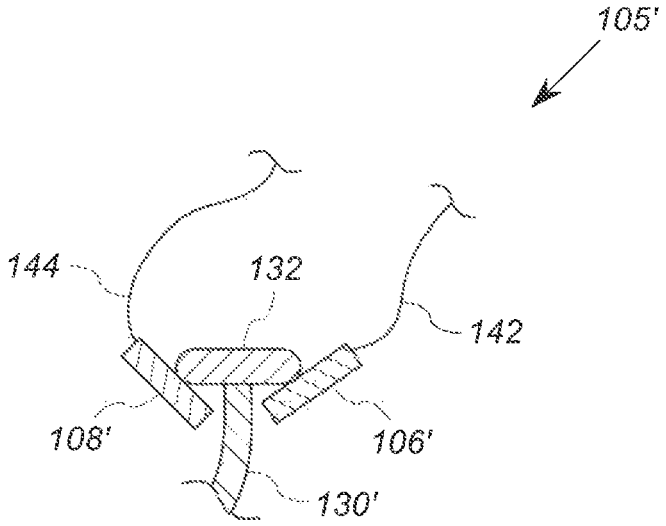
FIG. 10 shows a fragmentary cutaway view of alternative normally closed switch that may be used in the module of FIG. 6.

In another embodiment, it will be appreciated that the switch 105 may be configured as a normally closed switch, and that the motor 110 is operably to rotate responsive to the first and second contacts transitioning from the closed state to the open state. In an example of such an embodiment, the control circuit 150 may be the same as described above, except that it contains logic to provide power to motor 110 upon detection of an open connection between the wires 142 and 144 (see FIG. 7). To this end, FIG. 10 shows a fragmentary cutaway view of alternative normally closed switch 105' that may be used in the module 100 described above in place of the switch 105 of FIG. 6. In addition, the actuator 104 is modified such that the plate 132 is electrically conductive.

In particular, the switch 105' includes a first electrically conductive contact 106' electrically and physically coupled to the first wire 142, and a second electrically conductive contact 108' electrically and physically coupled to the second wires 144. The contacts 106', 108' may be mounted within the main compartment 120 in any suitable manner. In this case, when the actuator 104 is not actuated, the plate 132 physically engages and thereby completes the electrical connection between the contacts 106' and 108'. When a marble strikes the button or bulb 128, the shaft 130 moves upward, and the plate 132 disengages from the contacts 106', 108', thereby breaking the electrical contact. In this embodiment, the activation signal is the signal that results from the interruption of the connection between the wires 142, 144. When the control circuit 150 receives the activation signal, it provides the drive signal to the motor 110 for a predetermined amount of time, for example, three seconds.

In yet another embodiment, the control circuit 150 may provide the drive signal responsive to some other form of activation signal, such as that obtained wireless, or from an infrared sensor. For example, the actuator 104 and switch 105 may be replaced by another type of sensor located on the module 200, such as a rollover sensor or an infrared sensor. A rollover sensor can be located on the marble path 202, taking the form of any of the marble actuated switches disclosed in U.S. patent application Ser. No. 16/522,252, filed Jul. 25, 2019, which is incorporated herein by reference. In such a case, the marble actuated switch generates the activation signal and can convey the signal wirelessly, or through wire if the module 100 and the module 200 are designed as a single unit. In another embodiment, the switch 105 and actuator 104 may be replaced by a known infrared sensor configured to generate a activation signal when a marble is detected by the infrared sensor. The infrared sensor may be part of the module 100, the module 200 and possibly use wireless communications to signal a detection.

It will be appreciated that the above described embodiments are merely exemplary, and that those of ordinary skill in the art may readily devise their own implementations that incorporate the principles of the present invention and fall within the spirit and scope thereof.

In other features, the switch 105 may be replaced by an RF switch (e.g., on the PCB 104) that changes state based on an RF (e.g. Bluetooth) signal received from an external device. Such a signal could be received from a smart phone, or from a transmitter used in a track module 200.

What is claimed is:

1. An animation module configured for use on a marble run module of a plurality of physically interconnectable marble run modules, each marble run module configured to retain a marble and guide the travel of the marble through the module on at least a first surface, each marble run module having one or more connector tubes, the animation module comprising:

a connector configured to connect to a connector tube of a first marble run module of the plurality of physically interconnectable marble run modules;

an actuator having a button and a shaft, the actuator operably coupled to the connector to dispose at least a portion of the button below a bottom of a switch mount, the shaft coupled to extend upward from the button;

first and second switch contacts mounted at least indirectly on the switch mount, the first and second switch contacts having a closed state and an open state;

a motor operably coupled to the first and second switch contacts to rotate responsive to the first and second contacts transitioning from the open state to the closed state, or to rotate responsive to the first and second contacts transitioning from the closed state to the open state.

2. The animation module of claim 1, wherein the connector is further configured to guide axial movement of the shaft, and wherein axial movement of the actuator shaft causes transition between the closed state and the open state of the first and second switch contacts.

3. The animation module of claim 1, wherein the shaft has a first end coupled to the button, and a second end opposite the first end, and further comprising an electrically conductive contact disposed at the second end, and wherein in the closed state the electrically conductive contact closes a connection between the first switch contact and the second switch contact, and wherein in the open state the electrically conductive contact does not close a connection between the first switch contact and the second switch contact.

4. The animation module of claim 1, wherein the axial shaft is configured to cause movement of the first switch contact to transition the first and second switch contacts between the open state and the closed state.

5. The animation module of claim 4, wherein the shaft is configured to cause movement of the first switch contact to transition the first and second switch contacts from the open state to the closed state.

6. The animation module of claim 1, wherein the button comprises a bulb having a concave contact surface.

7. The animation module of claim 6, wherein the bulb includes a hemispherical end having the concave contact surface.

8. An animation module configured for use on a marble run module of a plurality of physically interconnectable marble run modules, each marble run module configured to retain a marble and guide the travel of the marble through the module on at least a first surface, the animation module comprising:

a housing configured to connect to a first marble run module of the plurality of physically interconnectable marble run modules;

a motor operably coupled to rotate responsive to receiving a drive signal;

a platen supported on the housing and operably coupled to the motor to rotate responsive to rotation of the motor;

a drive circuit operably configured to cause the drive signal to be provided to the motor responsive to receiving an activation signal;

a marble detection switch having an open state and a closed state, wherein the marble detection switch is configured to transition between the open state and the closed state responsive to detection of a marble, and the marble detection switch is configured to cause the activation signal to be provided to the drive circuit responsive to a transition between the open state and the closed state; and wherein the marble detection switch includes an actuator and first and second switch contacts, and wherein the actuator is-operably coupled to at least one of the group consisting of the first switch contact and the second switch contact to transition the first and second switch contacts between one of the open state and closed state to another of the open state and the closed state responsive to a marble contacting the actuator.

9. The animation module of claim 8, wherein marble detection switch includes an infrared sensor.

10. The animation module of claim 8, wherein the marble detection switch is supported on the housing.

11. The animation module of claim 8, wherein the motor is operably coupled to the platen via a plurality of gears.

12. The animation module of claim 11, further comprising a pedestal operably connected to be rotated by the plurality of gears, the pedestal operably coupled to the platen to rotate the platen when said pedestal rotates.

13. The animation module of claim 8, further comprising at least one connection pedestal extending upward from an upper surface of the platen, the at least one connection pedestal configured to couple with at least one correspondingly shaped receiver disposed on an animation object.

14. The animation module of claim 13, wherein the at least one connection pedestal is removably secured to the platen.

15. The animation of module of claim 8, wherein the housing includes a connector configured to connect to a connector tube of a first marble run module of the plurality of physically interconnectable marble run modules.

16. The animation module of claim 8, wherein the actuator includes a button, and wherein the actuator is operably coupled to at least one of the group consisting of the first switch contact and the second switch contact to transition the first and second switch contacts between one of the open state and closed state to another of the open state and the closed state responsive to the marble contacting the button.

17. The animation module of claim 8, wherein the marble detection switch is configured to transition between the open state and the closed state responsive to detection of a marble by the marble detection switch.

18. An animation module configured for use on a marble run module of a plurality of physically interconnectable marble run modules, each marble run module configured to retain a marble and guide the travel of the marble through the module on at least a first surface, the animation module comprising:

a housing configured to connect to a first marble run module of the plurality of physically interconnectable marble run modules;

a motor operably coupled to rotate responsive to receiving a drive signal;

a platen supported on the housing and operably coupled to the motor to rotate responsive to rotation of the motor;

a drive circuit operably configured to cause the drive signal to be provided to the motor responsive to receiving an activation signal;

a pedestal operably connected to be rotated by a plurality of gears, the pedestal operably coupled to the platen to rotate the platen when said pedestal rotates, wherein the pedestal includes an internal ring gear and a top flange, the top flange received by one or more features of the platen.

19. The animation module of claim 18, wherein the housing includes a base and a cap affixed thereto, the cap having an interior opening, and wherein the top flange of the pedestal extends through the interior opening.

* * * * *